US010274193B2

(12) United States Patent
Sung

(10) Patent No.: US 10,274,193 B2
(45) Date of Patent: Apr. 30, 2019

(54) TRANSFER PIPE FOR FURNACE

(71) Applicant: DOOSAN HEAVY INDUSTRIES CONSTRUCTION CO., LTD., Changwon-si (KR)

(72) Inventor: Min Suck Sung, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 54 days.

(21) Appl. No.: 14/740,819

(22) Filed: Jun. 16, 2015

(65) Prior Publication Data

US 2015/0362174 A1 Dec. 17, 2015

(30) Foreign Application Priority Data

Jun. 17, 2014 (KR) ..... 10-2014-0073704

(51) Int. Cl.

| | |
|---|---|
| ***F22B 37/10*** | (2006.01) |
| ***F22B 37/12*** | (2006.01) |
| ***F28F 1/40*** | (2006.01) |
| ***F28F 1/42*** | (2006.01) |
| ***F28F 13/02*** | (2006.01) |

(Continued)

(52) U.S. Cl.

CPC ..... *F22B 37/103* (2013.01); *F22B 37/12* (2013.01); *F28F 1/40* (2013.01); *F28F 1/42* (2013.01); *F28F 1/422* (2013.01); *F28F 13/02* (2013.01); *F28F 13/08* (2013.01); *F28F 13/12* (2013.01); *F28D 2021/0024* (2013.01)

(58) Field of Classification Search

CPC ..... F22B 37/103; F22B 37/12; F28D 2021/0024; F28F 1/40; F28F 1/42; F28F 1/422; F28F 13/02; F28F 13/08; F28F 13/12

USPC ..... 122/235.17, 235.22, 235.14, 235.23, 122/235.33; 138/170, 177

See application file for complete search history.

(56) References Cited

U.S. PATENT DOCUMENTS 2,864,588 A * 12/1958 Booth ..... F01M 5/002 138/38
3,779,312 A * 12/1973 Withers, Jr. ..... B21D 15/06 138/122

(Continued)

FOREIGN PATENT DOCUMENTS

| | | |
|---|---|---|
| JP | 2002081882 | 3/2002 |
| JP | 2010101508 | 5/2010 |

(Continued)

OTHER PUBLICATIONS

Communication dated Oct. 22, 2015 from the European Patent Office issued in counterpart Application No. 15172497.8.

(Continued)

*Primary Examiner* — Steven B McAllister
*Assistant Examiner* — Benjamin W Johnson
(74) *Attorney, Agent, or Firm* — Invenstone Patent, LLC

(57) ABSTRACT

Disclosed herein is a transfer pipe for a furnace. The transfer pipe for a furnace includes a body portion having an inlet and an outlet through which a fluid is transferred, a guide portion having polygonal sides extending in a spiral form in an inward longitudinal direction of the body portion, and a diameter change portion repeatedly changing an inner diameter of the body portion in the longitudinal direction thereof.

19 Claims, 8 Drawing Sheets

(51) Int. Cl.

| | |
|---|---|
| ***F28F 13/08*** | (2006.01) |
| ***F28F 13/12*** | (2006.01) |
| *F28D 21/00* | (2006.01) |

(56) References Cited

U.S. PATENT DOCUMENTS

| | | | | |
|---|---|---|---|---|
| 3,847,212 | A * | 11/1974 | Withers, Jr. | F28F 1/42 165/179 |
| 3,885,622 | A * | 5/1975 | McLain | B21C 37/0803 138/38 |
| 4,154,296 | A | 5/1979 | Fijas | |
| 4,248,179 | A * | 2/1981 | Bonner | F28F 1/40 122/235.14 |
| 4,330,036 | A * | 5/1982 | Satoh | F28F 1/42 165/179 |
| 7,044,210 | B2 * | 5/2006 | Usui | F28D 7/1607 138/177 |
| 2008/0029243 | A1 | 2/2008 | O'Donnell et al. | |
| 2011/0083619 | A1 * | 4/2011 | Master | F22B 1/16 122/32 |

FOREIGN PATENT DOCUMENTS

| | | |
|---|---|---|
| KR | 1996-0003476 | 3/1996 |
| KR | 10-2006-0009779 | 2/2006 |
| WO | 2009/045153 A1 | 4/2009 |

OTHER PUBLICATIONS

Korean Office Action for KO Application No. 10-2004-0073704 dated Jun. 15, 2015.

* cited by examiner

TRANSFER PIPE FOR FURNACE

CROSS-REFERENCE(S) TO RELATED APPLICATIONS

This application claims priority to Korean Patent Application No(s). 10-2014-0073704 filed on Jun. 17, 2014 the disclosure of which is incorporated herein by reference in its entirety.

BACKGROUND

Field

Exemplary embodiments of the present invention relate to a transfer pipe installed in a furnace of a thermal power plant, and more particularly, to a transfer pipe for a furnace, in which a height of a water wall in the transfer pipe is stably maintained so that deformation and damage of the transfer pipe may be minimized.

Description of the Related Art

In a general furnace used for a thermal power plant, when a fluid heated through an economizer is supplied to a header and is vertically moved through a plurality of transfer pipes mounted outside the furnace, high-temperature radiant heat transferred from the furnace is transferred to the transfer pipes.

The fluid is changed from a liquid phase to a steam phase by radiant heat transferred from the furnace in the transfer pipes. The steam has an increased high temperature when transferred via a superheater and a reheater so as to be used as a working fluid for driving a turbine.

When the fluid is transferred through the transfer pipes used for the above purpose in a state in which the transfer pipes are vertically installed outside the furnace, a section in which the fluid is changed from a liquid phase to a steam phase in the transfer pipes may be damaged and deformed due to a rapid increase in temperature.

Such a phenomenon is generated because a water wall formed by the fluid transferred through each transfer pipe has a relatively low height and a temperature is not stably maintained but is rapidly changed in the section in which a phase change to the steam is performed.

In addition, when the fluid or the steam is transferred through the transfer pipe, friction force may be increased due to an increase of an area coming into contact with an inside surface of the transfer pipe and a pressure pump may require a large capacity for supplying the fluid to the transfer pipe.

RELATED ART DOCUMENT

[Patent Document 1] Korean Patent Laid-open Publication No. 2014-0056079 (May 9, 2014)

SUMMARY

An object of the present invention is to provide a transfer pipe in which a water wall is capable of being formed to have a relatively high height by transferring a fluid through the transfer pipe in a state in which friction between the fluid and the transfer pipe is minimized.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a transfer pipe for a furnace includes a body portion having an inlet and an outlet through which a fluid is transferred, a guide portion extending as polygonal sides in a spiral form in an inward longitudinal direction of the body portion, and a diameter change portion repeatedly changing an inner diameter of the body portion in the longitudinal direction thereof.

The transfer pipe may have a polygonal cross-sectional shape therein.

The diameter change portion may protrude in a rounded form in the inward longitudinal direction of the body portion.

When one cycle is assumed to be a case in which the guide portion extends by an angle of 360° in the inward longitudinal direction of the body portion, the same cycle may be repeated in the whole longitudinal direction of the transfer pipe.

The guide portion may include a first guide portion extending in the inward longitudinal direction of the body portion from the inlet to have a first cycle in a first section in which the fluid is maintained as a liquid phase, a second guide portion extending upward from the first section to have a second cycle and formed in a second section in which the fluid is maintained as two liquid and gas phases, and a third guide portion extending toward the outlet from the second section to have a third cycle and formed in a third section in which the fluid is maintained as a gas phase.

The second guide portion may have the second cycle relatively shorter than the first cycle of the first guide portion.

The guide portion may have an inner peripheral surface which has an N-sided polygonal shape in the first section and an N−1 sided polygonal shape in the second section.

The first to third guide portions may obliquely extend while having a first inclined angle, a second inclined angle, and a third inclined angle, and the second inclined angle may be relatively greater than the first inclined angle.

The guide portion may include a branch passage formed on each polygonal side in order to increase a speed of the fluid transferred upward in the longitudinal direction of the transfer pipe.

The branch passage may be inclined in a direction in which the fluid is transferred in the spiral form in the inward longitudinal direction of the transfer pipe.

The branch passage may be formed across the first and second sections.

The branch passage may be formed in only the second section.

In accordance with another aspect of the present invention, a transfer pipe for a furnace includes a body portion having an inlet and an outlet through which a fluid is transferred, a guide portion extending as first to Nth polygonal sides in a spiral form in a longitudinal direction of the body portion having a polygonal cross-sectional shape, a round portion formed inside the body portion in a longitudinal direction of the polygonal sides and the polygonal sides adjacent thereto, and a diameter change portion repeatedly changing an inner diameter of the body portion in the longitudinal direction thereof.

The diameter change portion may protrude in a rounded form in the inward longitudinal direction of the body portion.

The guide portion may include a first guide portion extending from the inlet when one cycle is assumed to be a case in which the guide portion extends by an angle of 360° in the inward longitudinal direction of the body portion, the first guide portion being formed in a first section in which the fluid is maintained as a liquid phase, a second guide portion extending upward from the first section to have a second cycle and formed in a second section in which the fluid is maintained as two liquid and gas phases, and a third guide portion extending toward the outlet from the second section to have a third cycle and formed in a third section in which the fluid is maintained as a gas phase.

The second guide portion may have the second cycle relatively shorter than the first cycle of the first guide portion.

The guide portion may have an inner peripheral surface which has an N-sided polygonal shape in the first section and an N−1 sided polygonal shape in the second section.

The guide portion may include a branch passage formed on each polygonal side in order to increase a speed of the fluid transferred upward in the longitudinal direction of the transfer pipe.

The branch passage may be formed across the first and second sections.

The branch passage may be formed in only the second section.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
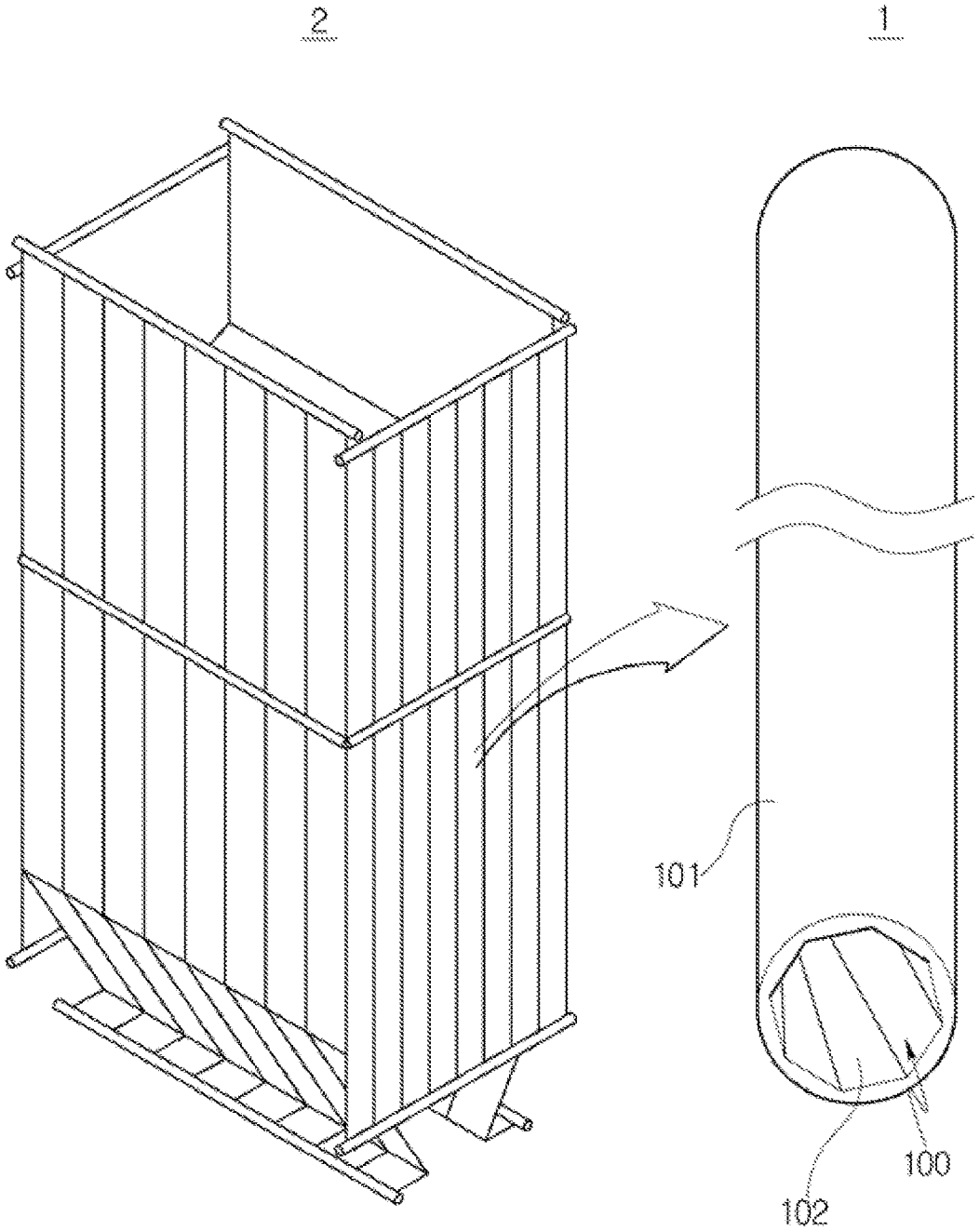
FIG. 1 is an enlarged perspective view illustrating a transfer pipe for a furnace according to an embodiment of the present invention.

A transfer pipe for a furnace according to exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention. The drawings are not necessarily to scale and in some instances, proportions may have been exaggerated in order to clearly illustrate features of the embodiments.

Figure 2:
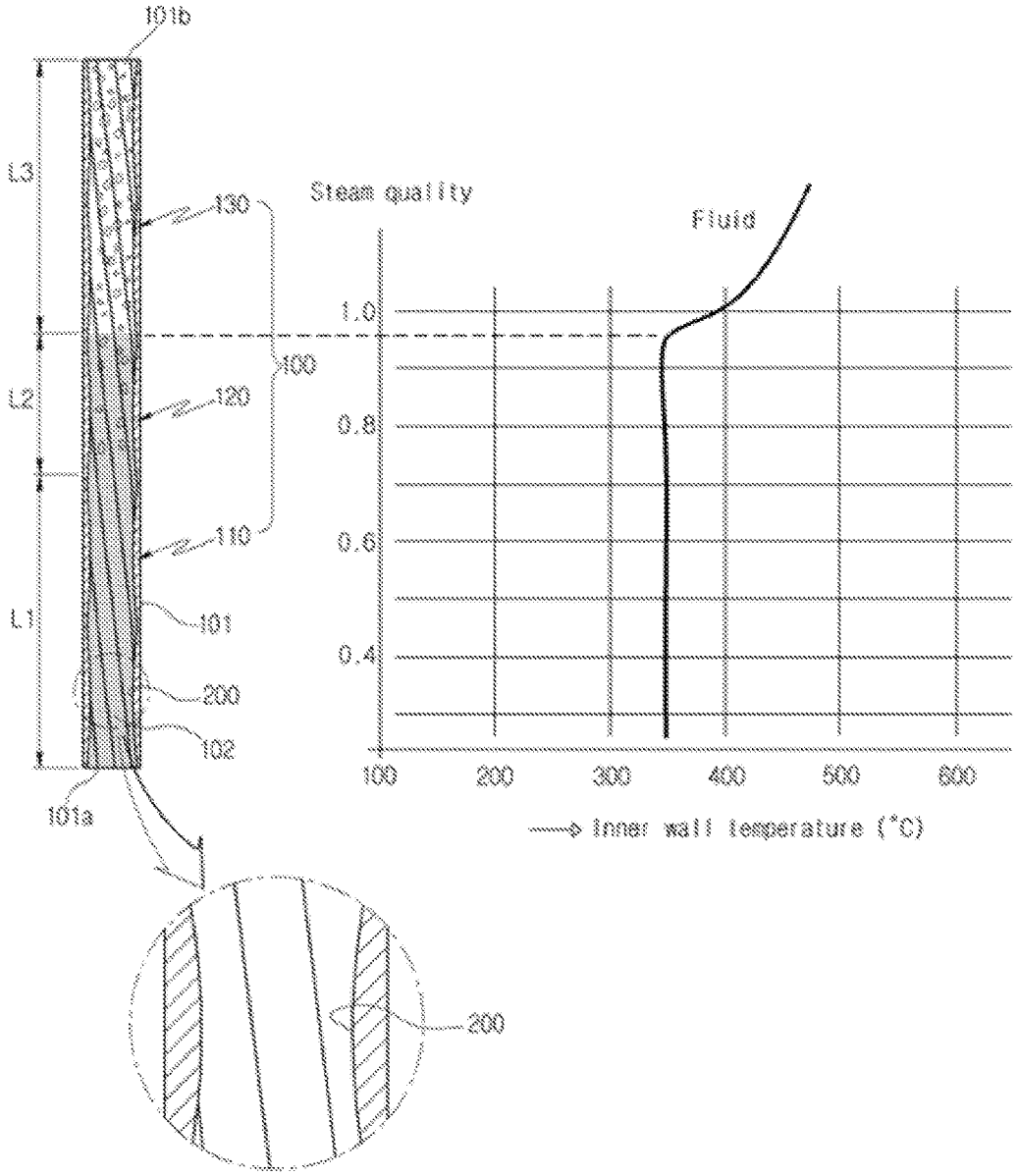
FIG. 2 is a detailed cross-sectional view illustrating the transfer pipe for a furnace for each section and a diagram illustrating a change in temperature of an inner wall of the transfer pipe together with a steam quantity according to the embodiment of the present invention.
Figure 3:
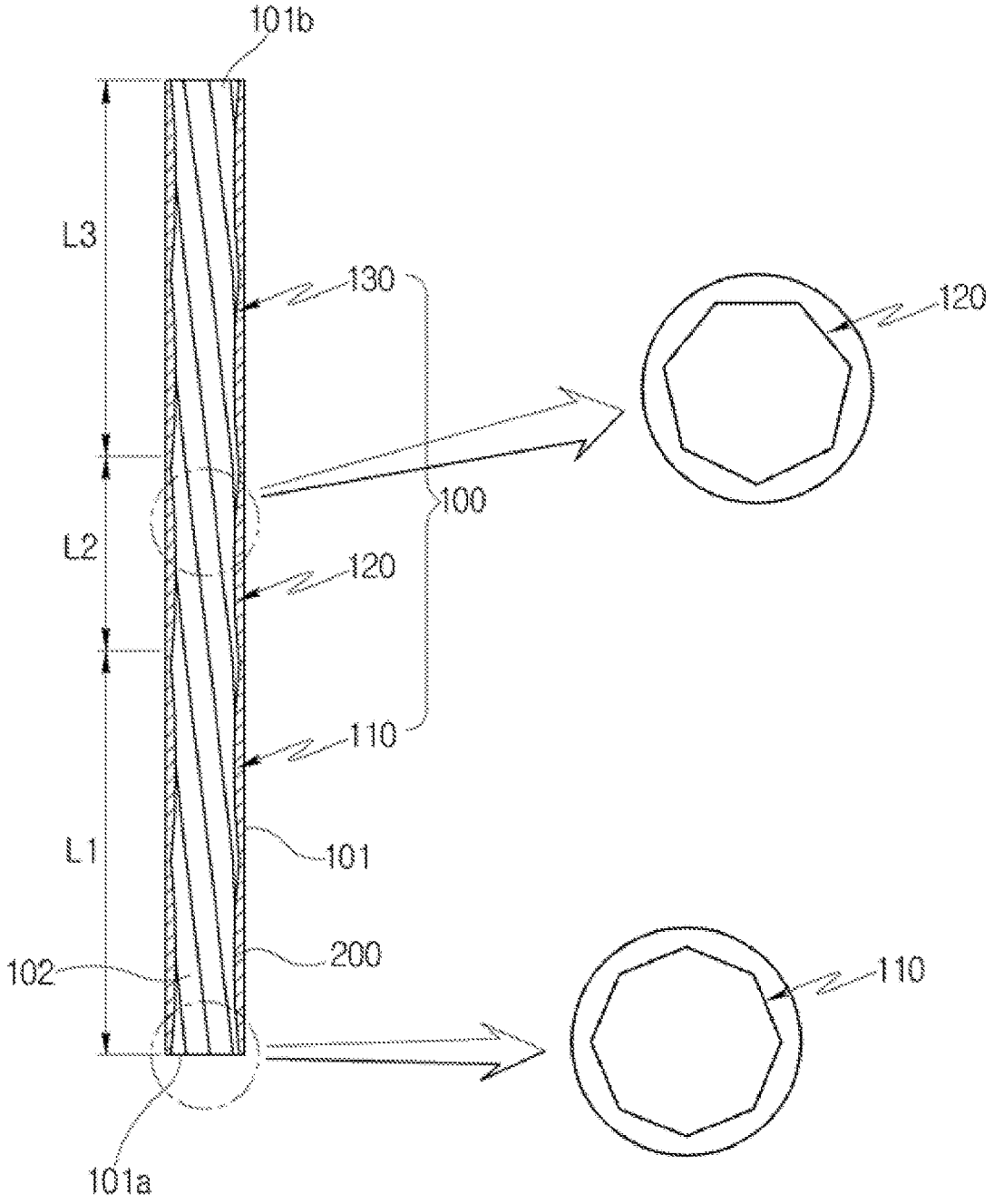
FIG. 3 is a view illustrating an example of first and second guide portions according to the embodiment of the present invention.

Referring to FIGS. 1 to 3, transfer pipes for a furnace 1, for example, are vertically installed outside a furnace 2 of a thermal power plant. Each of the transfer pipes 1 includes a guide portion 100 which extends as polygonal sides 102 in a spiral form in an inward longitudinal direction of a body portion 101 in order to increase heat quantity moved for a unit time through a unit area in the furnace 2 by supplying a high-temperature and high-pressure fluid thereto and to minimize friction generated between the fluid transferred into the body portion 101 and a wall thereof, and a diameter change portion 200 which repeatedly changes an inner diameter of the body portion 101 in the longitudinal direction thereof.

The transfer pipe 1 is vertically arranged outside the furnace 2. When the fluid moves inside the body portion 101, the flow of the fluid is changed in a spiral form. In the present embodiment, the transfer pipe 1 has a polygonal cross-sectional shape therein and the fluid is transferred between polygonal sides 102 forming the same in a minimized friction state. Therefore, a high water wall is formed in the transfer pipe, thereby absorbing high-temperature radiant heat generated by the furnace 2.

Although the transfer pipe 1 is configured such that the inside of the body portion 101 has an N-sided polygonal shape, the present invention is not limited thereto. The inside of the body portion 101 may preferably have a hexagonal or more shape.

The diameter change portion 200 protrudes in a rounded form in the inward longitudinal direction of the body portion, and an equal or similar number of diameter change portions as the number of sides of a polygon formed inside the transfer pipe 1 is formed.

For example, when the transfer pipe 1 has an octagonal shape, eight or seven diameter change portions 200 may protrude in the transfer pipe 1. In this case, when the fluid is transferred upward via the multiple diameter change portions 200, the speed of the fluid is increased since the fluid is transferred in a spiral form along an inside surface of the body portion 101. The diameter change portions 200 do not form boundary surfaces such as steps or grooves in sections spaced apart from each other, so that friction between the inside surface of the body portion 101 and the fluid moved therealong is relatively reduced and the water wall is formed to have a high height. Consequently, since a region in which the fluid is not present as it is but is present as a hot dry air phase is minimized, damage and deformation of the transfer pipe 1 are prevented.

Each diameter change portion 200 protrudes in an oval form toward the center from the inside of the body portion 101, and the outside thereof is formed in the rounded form by connecting a maximum protrusion point and a minimum protrusion point.

When the transfer pipe 1 is cut in section on the basis of the inside center thereof, the diameter change portions 200 are laterally symmetrically formed on the basis of the center to increase the speed of the fluid transferred inside the body portion 101. For example, each diameter change portion 200 may serve as a nozzle to relatively increase the speed of the fluid transferred through the transfer pipe 1, compared to a case of a transfer pipe having a uniform diameter.

The diameter change portions 200 repeatedly protrude in the longitudinal direction of the transfer pipe 1, and are not necessarily limited to having a shape illustrated in the drawings.

When one cycle is assumed to be a case in which the guide portion 100 extends by an angle of 360° in the inward longitudinal direction of the body portion 101, the same cycle is repeated in the whole longitudinal direction of the transfer pipe 1.

This repetition of the same cycle enables the fluid to be transferred to a specific height of the transfer pipe 1 by improving movement speed and minimizing friction when the fluid is moved in the longitudinal direction of the transfer pipe 1 by the guide portion 100 extending in the spiral form, instead of being transferred through a transfer pipe having a uniform diameter. One cycle of the guide portion formed in the body portion 101 is only illustrative to help understanding of the present invention, and is not necessarily limited to that illustrated in the drawings and may be modified. For reference, the transfer pipe 1 extends to have a length of several tens of meters, and may extend to have a length more than 100 m when individual unit transfer pipes mutually extend.

The guide portion 100 guides stable formation of the water wall by close contact between the fluid and the polygonal sides 102 in a state of being inclined by a predetermined angle along the inside of the body portion 101. In this case, since centrifugal force generated when the fluid transferred in the spiral form is increased, the fluid having a relatively heavier mass than the steam may be moved in a state of coming into maximum contact with the inside of the body portion 101.

When the guide portion having one cycle is formed inside the transfer pipe 1, the fluid is transferred from an inlet 101*a* to an outlet 101*b* in a state of being stably maintained at a predetermined speed. The transfer pipe 1 is divided into a section in which the fluid is present as a liquid phase, a section in which the fluid is present as liquid and gas phases, and a section in which the fluid is present as a hot steam phase, in the inward longitudinal direction of the transfer pipe 1.

In more detail, the guide portion 100 includes a first guide portion 110, a second guide portion 120, and a third guide portion 130, which are formed in the inward longitudinal direction of the body portion 101 from the inlet 101*a*.

The first guide portion 110 extends to have a first cycle in a first section L1 in which the fluid is maintained as a liquid phase, and the second guide portion 120 extends upward from the first section L1 to have a second cycle and is formed in a second section L2 in which the fluid is maintained as two liquid and gas phases.

The third guide portion 130 extends toward the outlet 101*b* from the second section L2 to have a third cycle and is formed in a third section L3 in which the fluid is maintained as a gas phase.

The first guide portion 110 is formed in the first section L1 on the basis of the inlet 101*a* so as to have the first cycle. The first section L1 is not limited to a specific length, but corresponds to a section illustrated in the drawings when the whole length of the transfer pipe 1 is assumed to be N m.

The first section L1 is a section in which high-temperature radiant heat generated by the furnace 2 is absorbed. In the first section L1, each polygonal side 102 extends in the spiral form to have the first cycle and the fluid is transferred by the centrifugal force generated in a state of coming into close contact with the inner wall of the body portion 101.

The water wall is formed by the centrifugal force generated in a state in which the fluid transferred through the first section L1 is pressed to the inside of the transfer pipe 1, and the fluid is transferred in the spiral form through the polygonal sides 102 in the first section L1. In addition, an area formed by face contact between the fluid and each polygonal side 102 is increased, and thus friction is relatively reduced and the first section L1 in the liquid phase has a relatively increased length.

The second section L2 is a section in which the fluid is changed from the liquid phase to the steam phase. In the second section L2, the fluid is maintained as two liquid and steam phases and the water wall is formed on the inner wall of the transfer pipe 1. The second section L2 extends to a height closest to the third section L3 in the steam phase.

The temperature of the fluid transferred through the transfer pipe and the height of the water wall will be described with reference to FIG. 2.

Referring to FIG. 2, when the high-temperature radiant heat is conducted to the inside of the body portion 101 in a state in which the transfer pipe 1 is installed to the furnace 2, the inner wall of the transfer pipe 1 has a temperature of 350° C. rapidly increased from the first section L1 to the second section L2 and the fluid is changed to the steam phase in the third section L3 to be described later so that the inner wall temperature of the transfer pipe 1 is increased to a temperature of 400° C. or more as illustrated in a right-upward direction in the graph.

Since the second section L2 has a relatively shorter length than the first section L1 and the guide portion 100 extends to have the second cycle, the water wall has a relatively high height. When a steam phase having 100% dry air is set to be 1.0, the water wall is stably formed up to a section having 0.95 or more dry air so that rupture and damage of the transfer pipe 1 may be prevented and an operation stop state due to repair and replacement of components may be prevented even though the furnace 2 is used for a long time.

Accordingly, since an economic loss due to heat exchange performance improvement and repair of the furnace 2 is minimized, the transfer pipe may be efficiently used.

The third section L3 is a section in which the fluid is maintained as the hot steam phase. The third guide portion 130 extends to have the third cycle and the third section L3 has a relatively longer length than the second section L2. The hot steam is moved to the outlet 101*b* through the polygonal sides 102 formed in the spiral form on the inner surface of the body portion 101 by the third guide portion 130.

The second guide portion 120 in the embodiment has the second cycle relatively shorter than the first cycle of the first guide portion 110. The second guide portion 120 is a section in which the fluid is maintained as two liquid and gas phases, and the liquid and the steam are transferred upward along the guide portion 100 in the second section L2. In this case, when the second cycle is relatively shorter than the first cycle, the centrifugal force is increased and thus the liquid and the steam are moved fast.

Accordingly, since the water wall formed in the second section L2 has a relatively high height, damage of the transfer pipe 1 may be prevented even when the transfer pipe 1 is exposed to the high-temperature radiant heat for a long time and durability and heat exchange performance of the transfer pipe may be relatively enhanced.

Referring to FIG. 3, the guide portion 100 has different polygonal shapes according to the first to third sections. For example, the inner peripheral surface of the guide portion has an N-sided polygonal shape in the first section L1, and has an N−1 sided polygonal shape in the second section L2.

When the number of polygonal sides 102 of the guide portion 100 is changed in the second section L2, the centrifugal force of the fluid transferred through the transfer pipe 1 is increased and the water wall has a relatively increased length.

For example, when the first guide portion 110 has an octagonal shape in the first section L1, the second guide portion 120 may have a heptagonal shape in the second section L2 such that the centrifugal force of the fluid is relatively increased and the water wall has an increased height.

For reference, the third section L3 is a section in which the steam is moved, and the third guide portion 130 may have an octagonal shape in the third section L3 similarly to in the first section L1. In this case, since the water wall is not formed in the third section L3, the fluid is transferred without an increase in centrifugal force.

Figure 4:
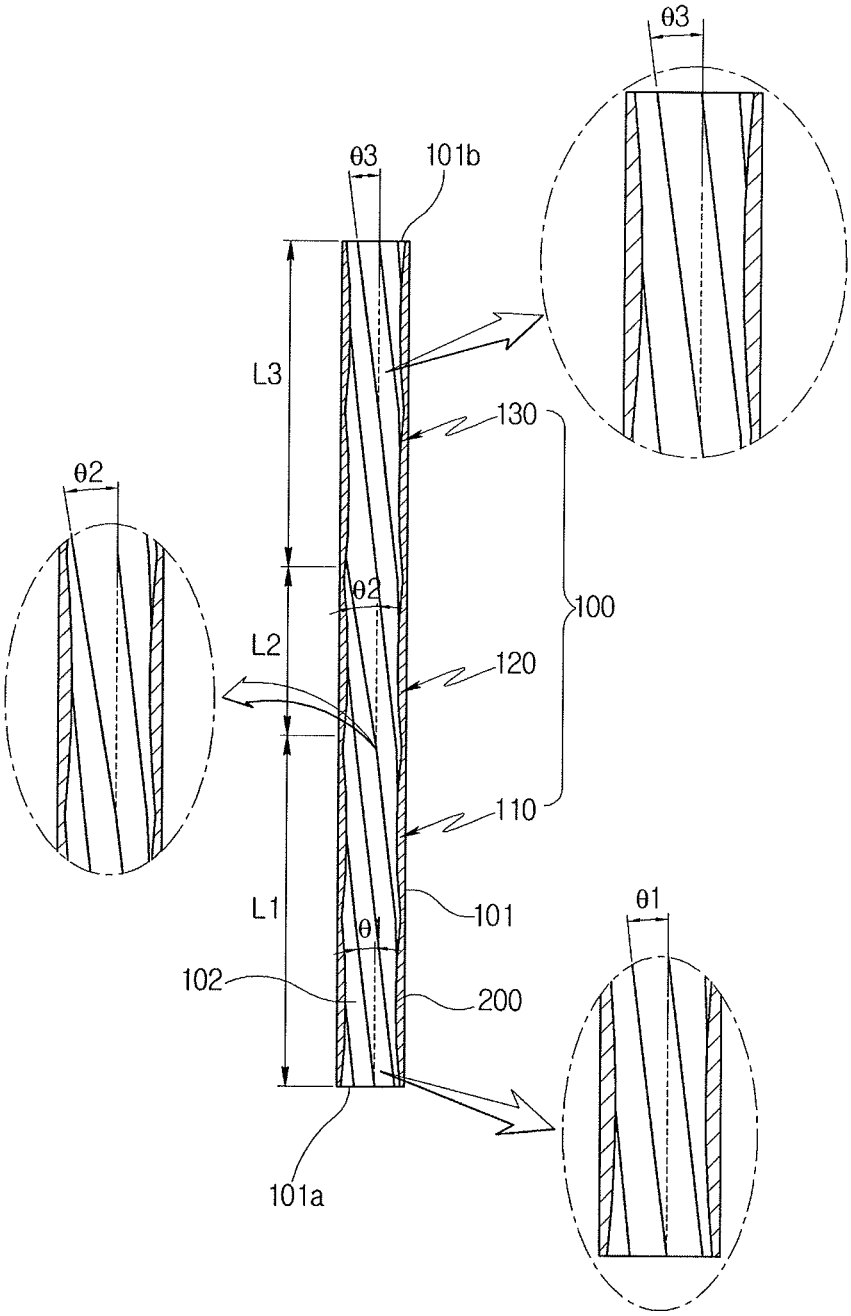
FIG. 4 is a view illustrating a change of angles of first to third guide portions according to the embodiment of the present invention.
Figure 5:
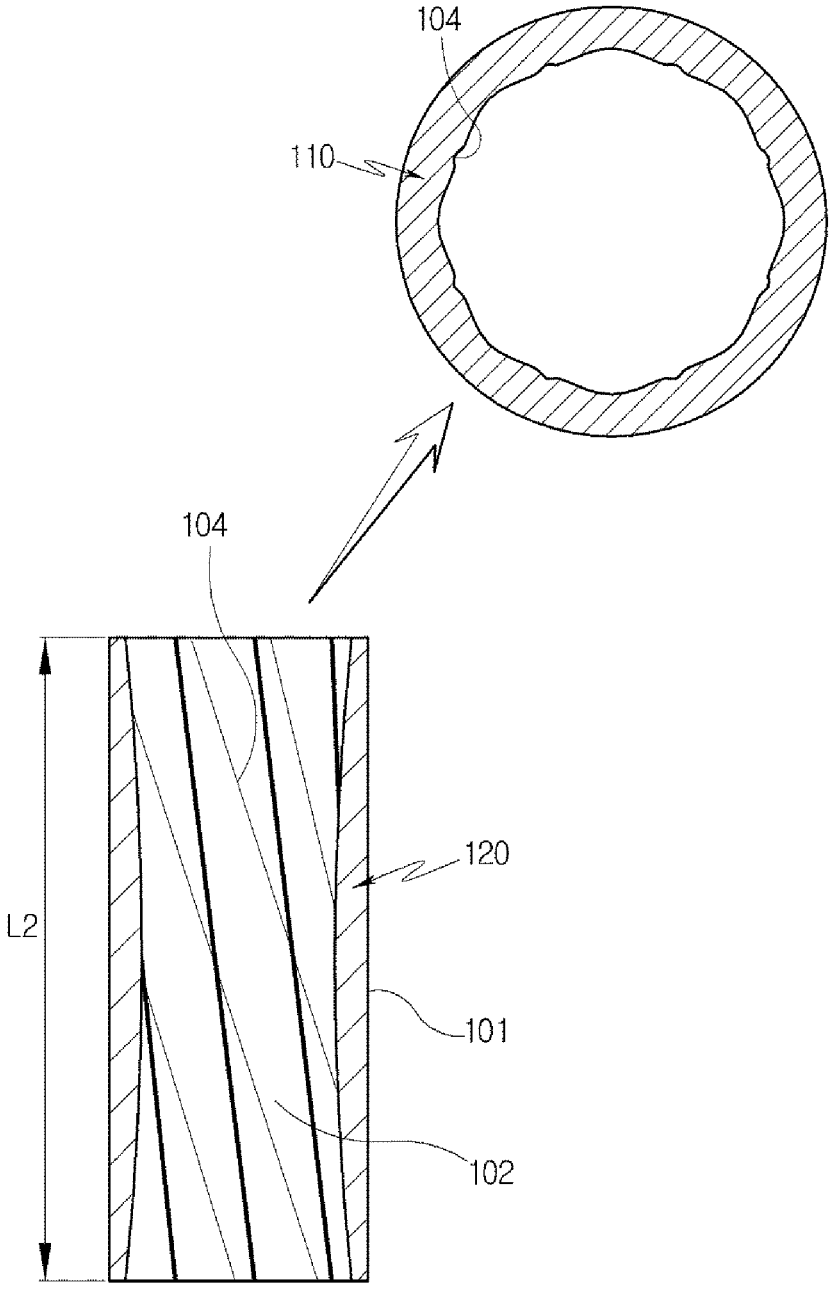
FIG. 5 is a view schematically illustrating a branch passage formed in the transfer pipe for a furnace, and a transverse cross-sectional view thereof, according to the embodiment of the present invention.

Referring to FIGS. 4 and 5, the first to third guide portions 110, 120, and 130 obliquely extend while having a first inclined angle θ1, a second inclined angle θ2, and a third inclined angle θ3 in the inside of the body portion 101.

For example, the second inclined angle θ2 is greater than the first inclined angle θ1. Although each of the first inclined angle θ1, the second inclined angle θ2, and the third inclined angle θ3 is not limited to a specific angle, the angle will be described to be an angle illustrated in the drawings.

The inclined angle means that each of the first to third guide portions 110 to 130 is inclined by a predetermined angle and extends in the spiral form instead of vertically extending along the inside of the body portion 101. Therefore, the speed and centrifugal force of the fluid transferred through the transfer pipe 1 and the formation height of the water wall are varied according to the inclined angles.

For example, the second inclined angle θ2 formed at the second guide portion 120 may be increased to a specific angle in order to increase the height of the water wall in the inside of the transfer pipe 1. In this case, damage of the transfer pipe 1 due to the high-temperature radiant heat may be stably prevented by increasing the centrifugal force and speed of the liquid and steam transferred in the spiral form along the second guide portion 120 and increasing the height of the water wall.

Referring to FIG. 5, the guide portion 100 includes a branch passage 104 formed on each polygonal side 102 in order to increase the speed of the fluid transferred upward in the longitudinal direction of the transfer pipe 1. The branch passage 104 is formed to change the number of polygonal sides 102 described above and increase the speed of the fluid transferred through the transfer pipe 1 together with the inclined angle. The branch passage 104 is obliquely formed between the adjacent polygonal sides 102 to increase the speed of the fluid transferred through the guide portion 100.

The branch passage 104 is inclined in a direction in which the fluid is transferred through the transfer pipe 1 and has an inclined angle of 45° or less. The branch passage is inclined at an angle similar to each of the first to third inclined angles θ1 to θ3.

This enables the fluid to be stably transferred in the spiral form through the transfer pipe 1. Consequently, the centrifugal force of the fluid is improved and the height of the water wall is stably maintained to a specific height of the second section L2.

The branch passage 104 is not formed in the whole longitudinal direction of the transfer pipe 1 but is formed across the first and second sections L1 and L2 so that a water film is formed to have a specific height. Consequently, the speed of the fluid transferred into the body portion 101 may be relatively increased.

A branch passage 104 according to another embodiment of the present invention is formed in only the second section L2 so that a water film may be formed to have a relatively high height in a section in which the fluid is maintained as two liquid and gas phases. Consequently, damage of the transfer pipe 1 may be prevented and the transfer pipe 1 may be stably used even when the transfer pipe 1 is used for a long time in a state of being installed to the furnace 2.

A configuration of a transfer pipe for a furnace according to another embodiment of the present invention will be described with reference to the drawings.

Figure 6:
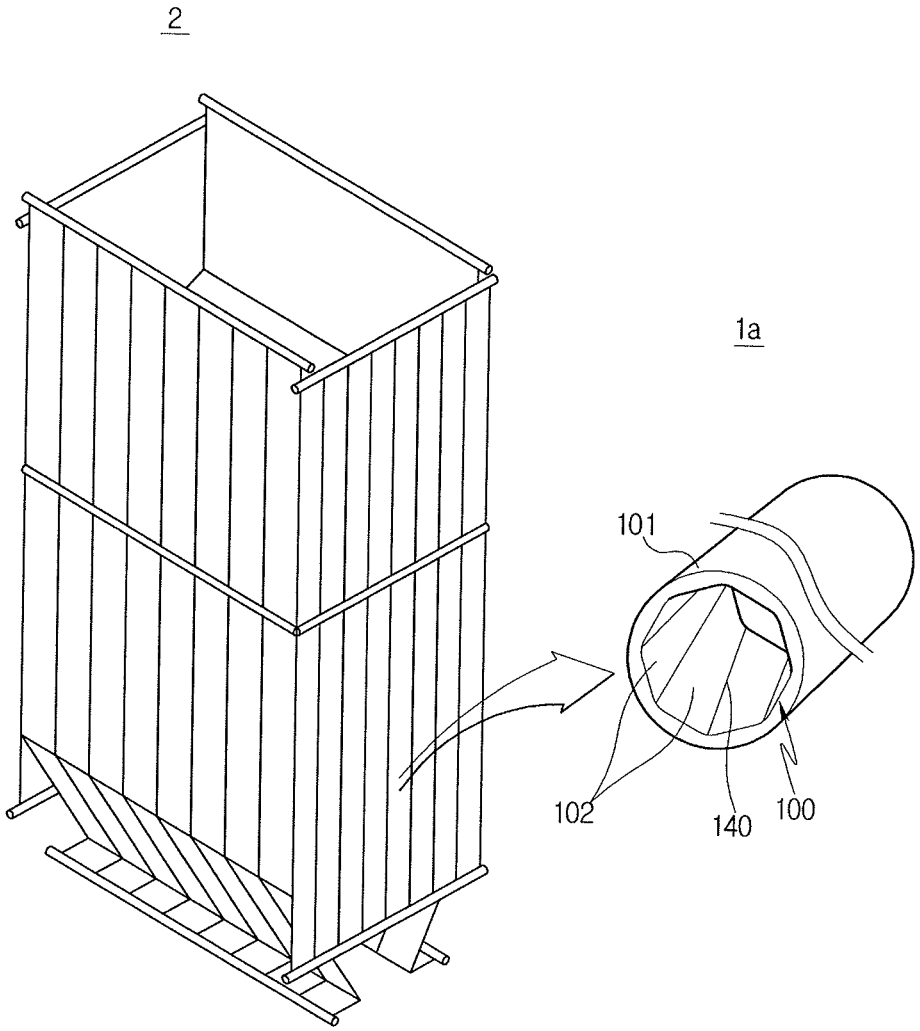
FIG. 6 is a perspective view illustrating a transfer pipe for a furnace according to another embodiment of the present invention.
Figure 7:
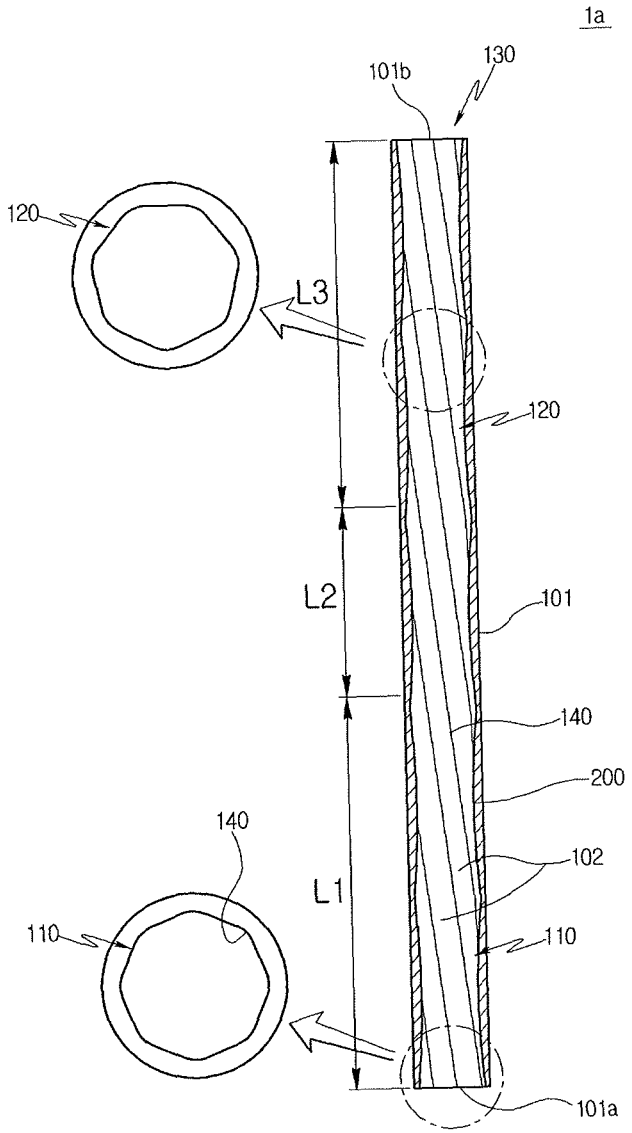
FIG. 7 is a detailed cross-sectional view illustrating the transfer pipe for a furnace for each section according to another embodiment of the present invention.

Referring to FIGS. 6 and 7, transfer pipes for a furnace 1*a* are vertically arranged. Each of the transfer pipes 1*a* includes a body portion 101 having an inlet 101*a* and an outlet 101*b* through which a fluid is transferred. The body portion 101 has a polygonal cross-sectional shape. The transfer pipe 1*a* includes a guide portion 100 which extends as first to Nth polygonal sides 102 in a spiral form in a longitudinal direction of a body portion 101, a round portion 140 formed inside the body portion 101 in a longitudinal direction of the polygonal sides 102 and the polygonal sides 102 adjacent thereto, and a diameter change portion 200 which repeatedly changes an inner diameter of the body portion 101 in the longitudinal direction thereof.

Since the diameter change portion 200 has the same configuration as that of the above embodiment, detailed description thereof will be omitted.

Unlike the above embodiment, the round portion 140 is formed in the present embodiment. Thus, a water wall of the fluid transferred through the transfer pipe 1*a* may be formed to have a relatively high height by a reduction of friction between the polygonal sides 102 and a pressure pump having a relatively low capacity may be used to supply the fluid to the transfer pipe 1*a*. Therefore, the transfer pipe has improved economics.

To this end, the transfer pipe 1*a* is vertically arranged outside the furnace 2 and the fluid is moved in the spiral form along the inside of the body portion 101. In the present embodiment, the transfer pipe 1*a* has a polygonal cross-sectional shape therein and the fluid is transferred between polygonal sides 102 in a minimized friction state. Therefore, a high water wall is formed in the transfer pipe, thereby absorbing high-temperature radiant heat generated by the furnace 2.

Although the transfer pipe 1*a* is configured such that the inside of the body portion 101 has an N-sided polygonal shape, the present invention is not limited thereto. The inside of the body portion 101 may preferably have a hexagonal to decagonal shape.

When one cycle is assumed to be a case in which the guide portion 100 extends by an angle of 360° in the inward longitudinal direction of the body portion 101, the same cycle is repeated in the whole longitudinal direction of the transfer pipe 1*a*.

This repetition of the same cycle enables the fluid to be transferred to a specific height of the transfer pipe 1*a* by improving movement speed of the fluid and minimizing friction.

One cycle of the guide portion guides stable formation of the water wall by close contact between the fluid and the polygonal sides 102 in a state of being inclined by a predetermined angle along the inside of the body portion 101. In this case, since centrifugal force generated when the fluid transferred in the spiral form is increased, the fluid having a relatively heavier mass than the steam may be moved in a state of coming into maximum contact with the inside of the body portion 101.

When the guide portion having one cycle is formed inside the transfer pipe 1*a*, the fluid is transferred from the inlet 101*a* to the outlet 101*b* in a state of being stably maintained at a predetermined speed. The transfer pipe 1*a* is divided therein into a section in which the fluid is present as a liquid phase, a section in which the fluid is present as liquid and gas phases, and a section in which the fluid is present as a steam phase.

In more detail, the guide portion 100 includes a first guide portion 110, a second guide portion 120, and a third guide portion 130, which are formed in the inward longitudinal direction of the body portion 101 from the inlet 101*a*.

The first guide portion 110 extends to have a first cycle in a first section L1 in which the fluid is maintained as a liquid phase, and the second guide portion 120 extends upward from the first section L1 to have a second cycle and is formed in a second section L2 in which the fluid is maintained as two liquid and gas phases.

The third guide portion 130 extends toward the outlet 101*b* from the second section L2 to have a third cycle and is formed in a third section L3 in which the fluid is maintained as a gas phase.

The first guide portion 110 is formed in the first section L1 on the basis of the inlet 101*a* so as to have the first cycle. The first section L1 is not limited to a specific length, but corresponds to a section illustrated in the drawings when the whole length of the transfer pipe 1*a* is assumed to be N m.

The first section L1 is a section in which high-temperature radiant heat generated by the furnace 2 is absorbed. In the first section L1, each polygonal side 102 extends in the spiral form to have the first cycle and the fluid is transferred by the centrifugal force generated in a state of coming into close contact with the inner wall of the body portion 101.

The water wall is formed by the centrifugal force generated in a state in which the fluid transferred through the first section L1 is pressed to the inside of the transfer pipe 1*a*, and the fluid is transferred in the spiral form through the polygonal sides 102 in the first section L1. In addition, an area formed by face contact between the fluid and each polygonal side 102 is increased, and thus friction is relatively reduced and the first section L1 in the liquid phase has a relatively increased length.

The second section L2 is a section in which the fluid is changed from the liquid phase to the steam phase. In the second section L2, the fluid is maintained as two liquid and steam phases and the water wall is formed on the inner wall of the transfer pipe 1*a*. The second section L2 extends to a height closest to the third section L3 in the steam phase.

For example, when the high-temperature radiant heat is conducted to the inside of the body portion 101 in a state in which the transfer pipe 1*a* is installed to the furnace 2, the inner wall of the transfer pipe 1*a* has a temperature rapidly increased from the first section L1 to the second section L2 and the fluid is changed to the steam phase in the third section L3 to be described later.

The second section L2 has a relatively shorter length than the first section L1 and the guide portion 100 extends to have the second cycle.

When the water wall has a relatively high height in the second section L2 and a steam phase having 100% dry air is set to be 1.0, the water wall is stably formed up to a section having 0.95 or more dry air so that rupture and damage of the transfer pipe 1*a* may be prevented and an operation stop state due to repair and replacement of components may be prevented even though the furnace 2 is used for a long time (see FIG. 2).

Accordingly, since an economic loss due to heat exchange performance improvement and repair of the furnace 2 is minimized, the transfer pipe may be efficiently used.

The third section L3 is a section in which the fluid is maintained as the hot steam phase. The third guide portion 130 extends to have the third cycle and the third section L3 has a relatively longer length than the second section L2. The hot steam is moved to the outlet 101*b* through the polygonal sides 102 formed in the spiral form on the inner surface of the body portion 101 by the third guide portion 130.

The second guide portion 120 in the embodiment has the second cycle relatively shorter than the first cycle of the first guide portion 110. The second guide portion 120 is a section in which the fluid is maintained as two liquid and gas phases, and the liquid and the steam are transferred upward along the guide portion 100 in the second section L2. In this case, when the second cycle is relatively shorter than the first cycle, the centrifugal force is increased and thus the liquid and the steam are moved fast.

Accordingly, since the water wall formed in the second section L2 has a relatively high height, damage of the transfer pipe 1*a* may be prevented even when the transfer pipe 1*a* is exposed to the high-temperature radiant heat for a long time and durability and heat exchange performance of the transfer pipe may be relatively enhanced.

The guide portion 100 has different polygonal shapes according to the first to third sections. For example, the inner peripheral surface of the guide portion has an N-sided polygonal shape in the first section L1, and has an N−1 sided polygonal shape in the second section L2.

When the number of polygonal sides of the guide portion 100 is changed in the second section L2, the centrifugal force of the fluid transferred through the transfer pipe 1*a* is increased and the water wall has a relatively increased length.

For example, when the first guide portion 110 has an octagonal shape in the first section L1, the second guide portion 120 may have a heptagonal shape in the second section L2 such that the centrifugal force of the fluid is relatively increased and the water wall has an increased height.

For reference, the third section L3 is a section in which the steam is moved, and the third guide portion 130 may have an octagonal shape in the third section L3 similarly to in the first section L1. In this case, since the water wall is not formed in the third section L3, the fluid is transferred without an increase in centrifugal force.

The first to third guide portions 110, 120, and 130 obliquely extend while having a first inclined angle θ1, a second inclined angle θ2, and a third inclined angle θ3 in the inside of the body portion 101. Since this configuration is similar to that illustrated in FIG. 4, description thereof will be given with reference to FIG. 4. For example, the second inclined angle θ2 is greater than the first inclined angle θ1. Although each of the first inclined angle θ1, the second inclined angle θ2, and the third inclined angle θ3 is not limited to a specific angle, the angle will be described to be an angle illustrated in the drawings.

The inclined angle means that each of the first to third guide portions 110 to 130 is inclined by a predetermined angle and extends in the spiral form instead of vertically extending along the inside of the body portion 101. Therefore, the speed and centrifugal force of the fluid transferred through the transfer pipe 1*a* and the formation height of the water wall are varied according to the inclined angles.

For example, the second inclined angle θ2 formed at the second guide portion 120 may be increased to a specific angle in order to increase the height of the water wall in the inside of the transfer pipe 1*a*. In this case, damage of the transfer pipe 1*a* due to the high-temperature radiant heat may be stably prevented by increasing the centrifugal force and speed of the liquid and steam transferred in the spiral form along the second guide portion 120 and increasing the height of the water wall.

Figure 8:
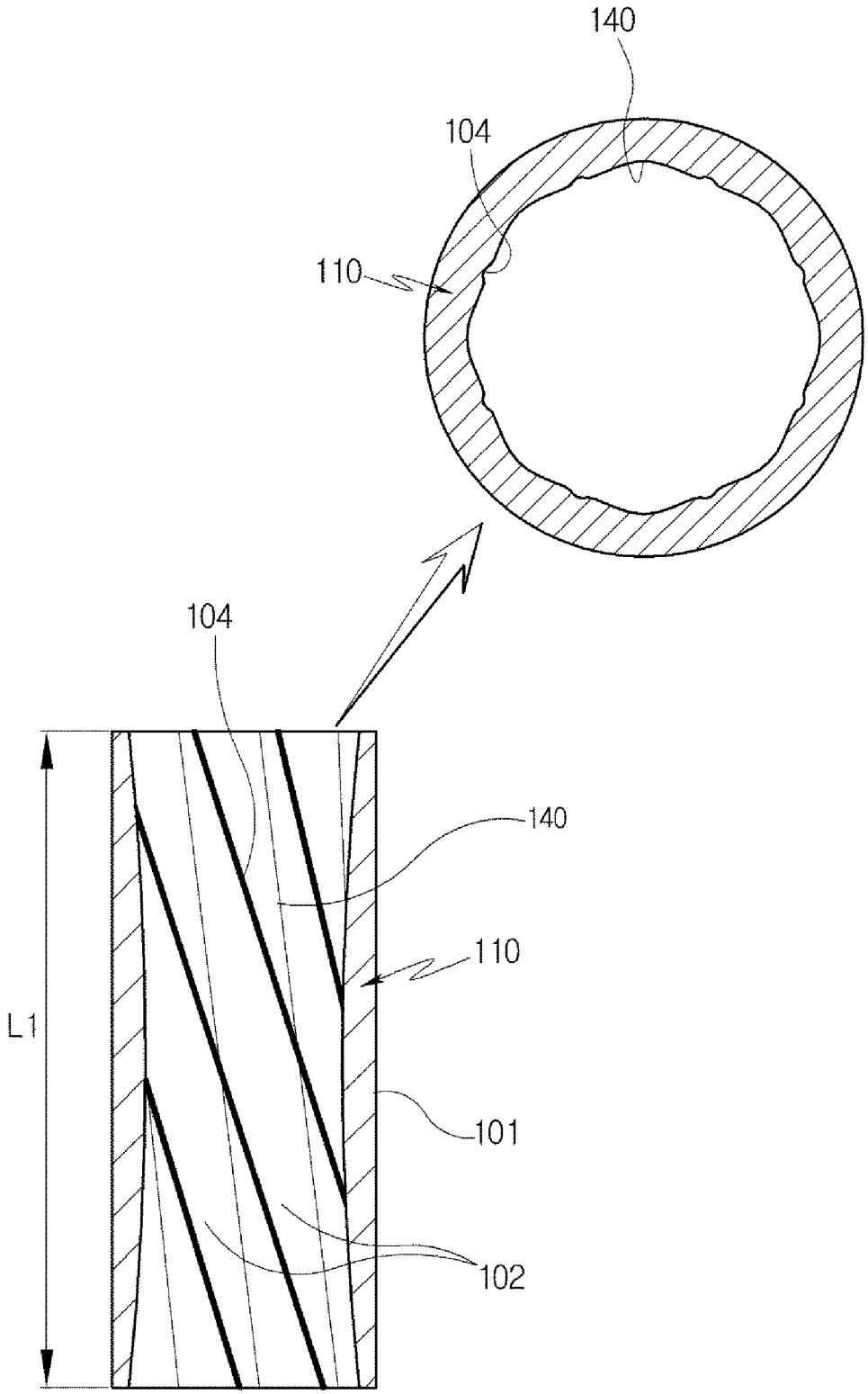
FIG. 8 is a view illustrating a branch passage formed in the transfer pipe for a furnace, and a transverse cross-sectional view thereof, according to another embodiment of the present invention.

Referring to FIG. 8, the guide portion 100 includes a branch passage 104 formed on each polygonal side 102 in order to increase the speed of the fluid transferred upward in the longitudinal direction of the transfer pipe 1*a*. The branch passage 104 is formed to change the number of polygonal sides 102 described above and increase the speed of the fluid transferred through the transfer pipe 1*a* together with the inclined angle. The branch passage 104 is obliquely formed between the adjacent polygonal sides 102 to increase the speed of the fluid transferred through the guide portion 100.

The branch passage 104 is inclined in a direction in which the fluid is transferred through the transfer pipe 1*a* and has an inclined angle of 45° or less. The branch passage is inclined at an angle similar to each of the first to third inclined angles θ1 to θ3.

This enables the fluid to be stably transferred in the spiral form through the transfer pipe 1*a* when the branch passage 104 has an inclined angle relatively greater than the first to third inclined angles θ1 to θ3. Consequently, the centrifugal force of the fluid is improved and the height of the water wall is stably maintained to a specific height of the second section L2.

The branch passage 104 is not formed in the whole longitudinal direction of the transfer pipe 1*a* but is formed across the first and second sections L1 and L2 so that a water film is formed to have a specific height. Consequently, the speed of the fluid transferred into the body portion 101 may be relatively increased.

A branch passage 104 according to another embodiment of the present invention is formed in only the second section L2 so that a water film may be formed to have a relatively high height in a section in which the fluid is maintained as two liquid and gas phases. Consequently, damage of the transfer pipe 1*a* may be prevented and the transfer pipe 1*a* may be stably used even when the transfer pipe 1*a* is used for a long time in a state of being installed to the furnace 2.

As is apparent from the above description, in accordance with exemplary embodiments of the present invention, a transfer pipe can be stably used for a long time by previously preventing a failure due to damage and deformation even though high-temperature radiant heat is conducted to the transfer pipe through a furnace.

In addition, it is possible to form a water wall having a relatively high height by minimizing resistance of a fluid transferred through the transfer pipe, and to minimize direct friction between the fluid and an inside surface of the transfer pipe.

While the present invention has been described with respect to the specific embodiments, it will be apparent to those skilled in the art that various changes and modifications may be made without departing from the spirit and scope of the invention as defined in the following claims.

What is claimed is:

1. A transfer pipe for a furnace, comprising:

a body portion having an inlet and an outlet through which a fluid is transferred;

a guide portion having polygonal sides formed on an inner wall of the body portion and extending in a spiral form in a longitudinal direction of the body portion;

diameter change portions that repeatedly protrude in a longitudinal direction of the transfer pipe from the inner wall of the body portion in a rounded form; and a branch passage formed on the inner wall of the body portion, wherein the branch passage is inclined with respect to the polygonal sides, so as to intersect with adjacent ones of the polygonal sides, wherein the guide portion has an inner peripheral surface which has an N-sided polygonal cross-section in a first section and an (N−1)-sided polygonal cross-section in a second section, wherein N is a positive integer, wherein the guide portion comprises a first guide portion extending in the longitudinal direction of the body portion from the inlet and a second guide portion extending upward from the first guide portion, and wherein an angle of extension of the first guide portion with respect to a center vertical axis is different from an angle of extension of the second guide portion with respect to the center vertical axis.

2. The transfer pipe according to claim 1, wherein the transfer pipe has a polygonal cross-sectional shape therein.

3. The transfer pipe according to claim 1, wherein the guide portion extends by an angle of 360° in the longitudinal direction of the body portion to form a cycle, and the cycle is repeated along an entire length of the transfer pipe.

4. The transfer pipe according to claim 1, wherein the first guide portion is configured to have a first cycle in the first section of the guide portion in which the fluid is maintained as a liquid phase and the second guide portion is configured to have a second cycle in the second section of the guide portion in which the fluid is maintained as a liquid phase and a gas phase, and wherein the guide portion further comprises a third guide portion extending toward the outlet from the second section, wherein the third guide portion is configured to have a third cycle in a third section of the guide portion in which the fluid is maintained as a gas phase.

5. The transfer pipe according to claim 4, wherein a length of the second guide portion is relatively shorter than a length of the first guide portion.

6. The transfer pipe according to claim 4, wherein:

the angle of extension of the entirety of the second guide portion with respect to the center vertical axis is relatively greater than the angle of extension of the entirety of the first guide portion with respect to the center vertical axis.

7. The transfer pipe according to claim 4, wherein the branch passage is formed across the first and second sections.

8. The transfer pipe according to claim 4, wherein the branch passage is formed in only the second section.

9. The transfer pipe according to claim 1, wherein the angle of extension of the first guide portion is uniform throughout the first guide portion, and wherein the angle of extension of the second guide portion is uniform throughout the second guide portion.

10. A transfer pipe for a furnace, comprising:

a body portion having an inlet and an outlet through which a fluid is transferred;

a guide portion formed on an inner wall of the body portion and extending in a spiral form in a longitudinal direction of the body portion, so that the body portion has a polygonal cross-sectional shape;

wherein the polygonal cross-sectional shape includes polygonal sides and a junction of adjacent ones of the polygonal sides is rounded; and diameter change portions that repeatedly protrude in a longitudinal direction of the transfer pipe that are disposed on each of the polygonal sides, wherein the guide portion has an inner peripheral surface which has an N-sided polygonal cross-section in a first section and an (N−1)-sided polygonal cross-section in a second section, wherein N is a positive integer, wherein the guide portion comprises a first guide portion extending in the longitudinal direction of the body portion from the inlet and a second guide portion extending upward from the first guide portion, and wherein an angle of extension of an entirety of the first guide portion with respect to a center vertical axis is different from an angle of extension of an entirety of the second guide portion with respect to the center vertical axis.

11. The transfer pipe according to claim 10, wherein the diameter change portions protrude from the inner wall of the body portion in a rounded form in the longitudinal direction of the transfer pipe.

12. The transfer pipe according to claim 10, wherein the first guide portion is configured to have a first cycle in the first section of the guide portion in which the fluid is maintained as a liquid phase and the second guide portion is configured to have a second cycle in the second section of the guide portion in which the fluid is maintained as a liquid phase and a gas phase, and wherein the guide portion further comprises a third guide portion extending toward the outlet from the second section, wherein the third guide portion is configured to have a third cycle in a third section of the guide portion in which the fluid is maintained as a gas phase.

13. The transfer pipe according to claim 12, wherein a length of the second guide portion is relatively shorter than a length of the first guide portion.

14. The transfer pipe according to claim 12, wherein the guide portion comprises a branch passage formed on the inner wall of the body portion, wherein the branch passage is inclined with respect to the polygonal sides, so as to intersect with the adjacent ones of the polygonal sides.

15. The transfer pipe according to claim 14, wherein the branch passage is formed across the first and second sections.

16. The transfer pipe according to claim 14, wherein the branch passage is formed in only the second section.

17. The transfer pipe according to claim 10, wherein the angle of extension of the first guide portion is uniform throughout the first guide portion, and wherein the angle of extension of the second guide portion is uniform throughout the second guide portion.

18. A transfer pipe for a furnace, comprising:

a body portion having an inlet and an outlet through which a fluid is transferred, wherein an outer diameter of the body portion is uniform;

a guide portion having polygonal sides formed on an inner wall of the body portion and extending in a spiral form in a longitudinal direction of the body portion; and diameter change portions that repeatedly protrude in a longitudinal direction of the transfer pipe from the inner wall of the body portion in a rounded form, wherein the guide portion has an inner peripheral surface which has an N-sided polygonal cross-section in a first section and an (N−1)-sided polygonal cross-section in a second section, wherein N is a positive integer, wherein the guide portion comprises a first guide portion extending in the longitudinal direction of the body portion from the inlet and a second guide portion extending upward from the first guide portion, and wherein an angle of extension of the first guide portion with respect to a center vertical axis is different from an angle of extension of the second guide portion with respect to the center vertical axis.

19. The transfer pipe according to claim 18, wherein the angle of extension of the first guide portion is uniform throughout the first guide portion, and wherein the angle of extension of the second guide portion is uniform throughout the second guide portion.

* * * * *